United States Patent [19]

Simms

[11] Patent Number: 4,484,426

[45] Date of Patent: Nov. 27, 1984

[54] SUPPORT SYSTEM FOR LANDSCAPE SCREENS

[75] Inventor: Lawrence P. Simms, Lakewood, Ohio

[73] Assignee: Donn Incorporated, Westlake, Ohio

[21] Appl. No.: 313,387

[22] Filed: Oct. 21, 1981

[51] Int. Cl.[3] ..... E04B 2/82

[52] U.S. Cl. ..... 52/239; 52/27; 52/36; 52/126.4

[58] Field of Search ..... 52/126.1–126.7, 52/263, 239, 264, 262, 238, 236.6, 121, 64, 602, 36, 30, 27; 254/104

[56] References Cited

U.S. PATENT DOCUMENTS

| | | | |
|---|---|---|---|
| 1,667,534 | 4/1928 | Carpenter et al. | 52/239 |
| 2,103,168 | 12/1937 | Myers et al. | 52/710 |
| 2,105,095 | 1/1938 | Peterson | 52/239 |
| 3,768,222 | 10/1973 | Birum, Jr. | 52/239 |
| 3,866,364 | 2/1975 | Pollard | 52/126.4 X |
| 4,067,156 | 1/1978 | Downing, Jr. | 52/126.6 |
| 4,269,005 | 5/1981 | Timmons | 52/36 |
| 4,296,574 | 10/1981 | Stephens | 52/220 |
| 4,426,824 | 1/1984 | Swensen | 52/794 |

*Primary Examiner*—Alfred C. Perham

*Attorney, Agent, or Firm*—Pearne, Gordon, Sessions, McCoy, Granger & Tilberry

[57] ABSTRACT

A support system for landscape screens is disclosed in which the panels of an elevated or computer floor are provided with sockets which receive studs. The studs are mounted on tracks which, in turn, are secured to the lower side of the landscape screen. The tracks permit the studs to be located at various positions along the landscape screen so that the studs can be positioned within the sockets in the floor panels. The floor panel sockets are eccentrically located so that they can be located in a plurality of positions by properly orienting the panel within the floor system. Various height adjusting means are disclosed for adjusting the height of the studs, and in turn the screen above the floor surface. Further, various structures are illustrated for anchoring the tracks to the landscape screens.

19 Claims, 8 Drawing Figures

FIG.1
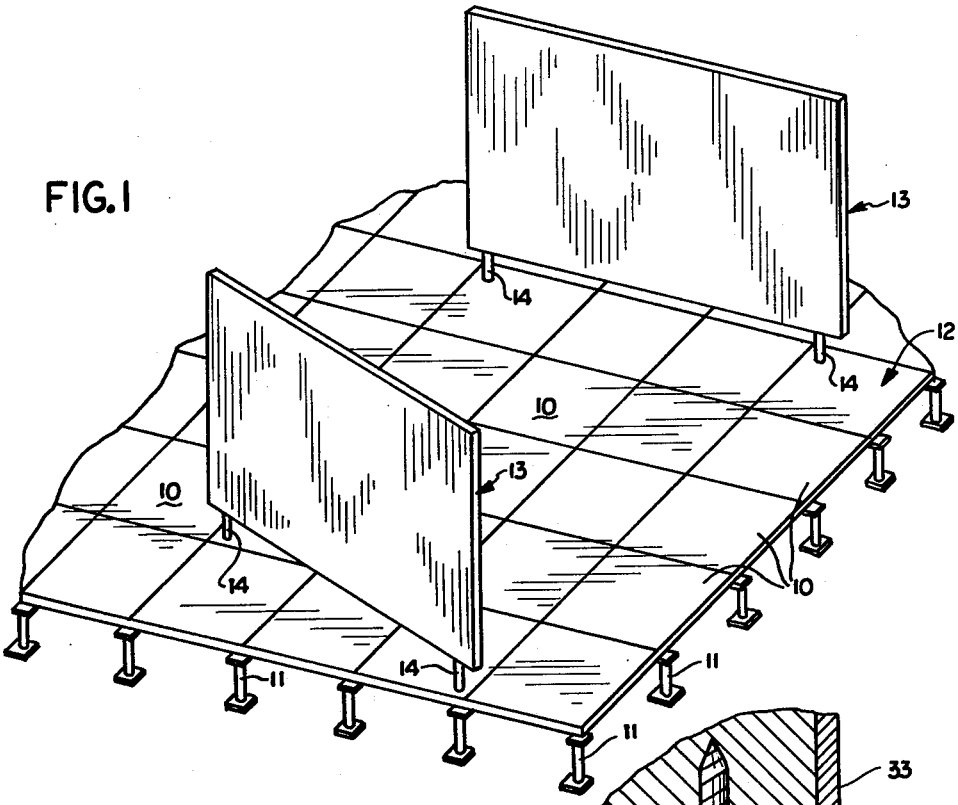
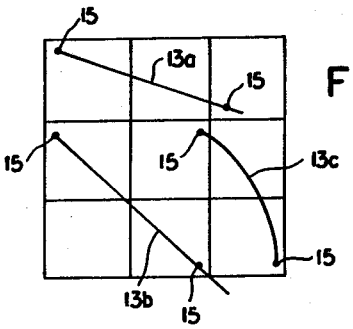
FIG.2
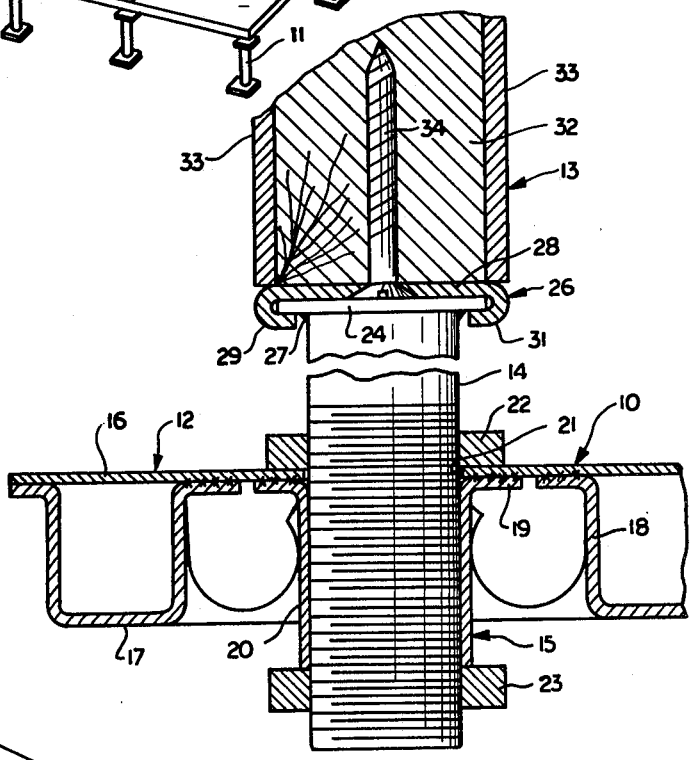
FIG.3
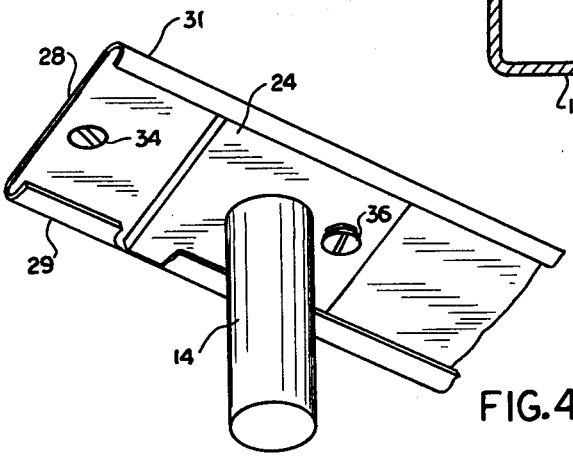
FIG.4

SUPPORT SYSTEM FOR LANDSCAPE SCREENS

BACKGROUND OF THE INVENTION

This invention relates generally to the support of landscape screens or the like, and more particularly to a novel and improved system for supporting landscape screens on elevated or computer floor systems.

PRIOR ART

Landscape screens are often used in commercial work areas to provide space dividers. For example, in a large, relatively open work area, screens are sometimes arranged to separate various areas to provide privacy, to break up open expanses, or to reduce distraction. Such screens are normally not fixed in place, but are movable so that they may be repositioned when work area revisions are required.

Usually, landscape screens are supported by legs or stands which merely rest on a floor structure and extend laterally from the plane of the screen to provide lateral support. Because the supports extend laterally from the screens to provide this lateral support, they provide obstructions to traffic which are undesirable. They also tend to limit the area in which furniture or other equipment can be located. Still further, such supports do not provide a secure support for the screens and the screens are sometimes bumped out of place or tipped over.

SUMMARY OF THE INVENTION

In accordance with the present invention, a novel and improved landscape screen support system is provided. Such support system combines sockets within the floor structure itself with removable studs and stud tracks which provide a secure landscape screen support, permit the placement of the screens in substantially any desired position, and also readily permit relocation of the screens when desired.

Further, the support system is located within the lateral confines of the screen itself so that it does not obstruct traffic or the placement of furniture or equipment.

The preferred embodiment of the support system is applied to a floor system including a plurality of removable panels which cooperate when installed to provide a large floor structure. Such floor system is provided, for example, in a floor system generally referred to as a "computer floor" or a "raised floor." Most such floor systems provide square floor panels which are supported by pedestals at a location above the building's basic floor structure to provide a subfloor space through which power lines can pass and/or through which ventilating and conditioning air may also pass. In such floor systems, individual panels may be removed and replaced as required. An example of such a raised or computer floor structure is illustrated in U.S. Pat. No. 4,067,156 and in the pending U.S. patent application Ser. No. 264,932, filed May 18, 1981.

The actual screen support system includes sockets provided in at least some of the floor panels. The system also includes studs which may be removably positioned in such sockets and mating tracks which are mounted on the lower edge of the landscape screens. The tracks and studs are provided with interfitting structure which allows the studs to be secured to the track at substantially any selected position along the tracks.

For installation of a screen in a desired location, floor panels are located within the floor system so as to provide sockets at the locations where the screen is to be supported. The tracks are mounted on the lower edge of the screen and the studs are positioned in the tracks and moved therealong to a position in which they can be inserted into the sockets. Preferably, means are provided to lock the studs relative to the track in the proper position therealong.

In addition, the studs may be provided with height-adjusting means so that the height of the supported screen with respect to the floor may be adjusted.

With the preferred embodiments illustrated, landscape screens can be positioned at substantially any location and readily moved as desired. Further, a firm support is provided so that the screen is fixed in place and is able to withstand the loads normally encountered thereby. Because the studs do not extend laterally from the screens and are within the envelope of the screen itself, the support system does not produce any traffic obstructions or any obstructions to the placement of furniture or other equipment.

Although the illustrated embodiment of this invention involves the mounting of landscape screens or the like, it is within the broader aspects of this invention to provide a floor system providing floor panels having support means for removably supporting other types of devices or accessories. For example, railing or light posts can be supported in the floor panel sockets illustrated.

These and other aspects of this invention are illustrated in the accompanying drawings, and are more fully described in the following specification.

BRIEF DESCRIPTION OF THE DRAWINGS

FIG. 1 is a fragmentary, perspective view of an elevated floor system having two landscape screens mounted thereon;

FIG. 2 is a schematic illustration of a floor system having landscape screens of various sizes and shapes mounted in random positions thereon;

FIG. 3 is an enlarged, fragmentary section illustrating a socket applied to one form of elevated floor panel and a stud which may be vertically adjusted with respect to the floor and locked in place;

FIG. 4 is a fragmentary, perspective view illustrating the track and stud interconnection;

DETAILED DESCRIPTION OF THE DRAWINGS

Figure 5:
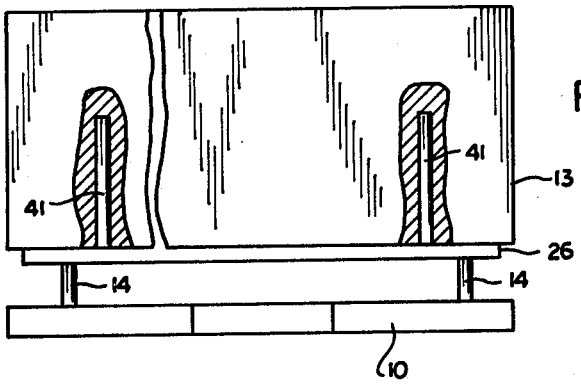
FIG. 5 is a schematic side elevation of a landscaping screen provided with a first system for anchoring the track on the screen.

FIG. 1 schematically illustrates a typical elevated floor system in which a plurality of square panels 10 are supported at their corners on pedestals 11 and cooperate to provide a floor surface 12 which is spaced up from the main floor structure of a building. A typical pedestal is illustrated in U.S. Pat. No. 4,113,219 (assigned to the assignee of the present invention). Typically, the panels are provided with a floor surface which may be a carpet or tile as the case may be. Such floor panels 10 are individually removable to provide access to the underfloor area between the panel system and the main floor of the building. Such underfloor area is often used for power cables and heating or cooling conditioning air.

In accordance with the present invention, support means are provided to support landscape screens 13 from the panels 10. In FIG. 1, two landscape screens 13 are illustrated, one of which is parallel to the side edges of the panels 12 and the other of which is positioned in a diagonal position with respect to the side edges of the panels. Each of the screens is supported by a pair of studs 14 which are spaced along the length of the screen and fit into sockets 15 provided in the floor panels 10, as discussed in detail below.

The sockets 15 may be mounted in any suitable manner in the floor panels 10. Various types of floor panels 10 are known in the prior art. For example, some floor panels provide a metal surface which surrounds a core and other panels are fabricated from sheet metal. In the drawings, this invention is illustrated as applied to a floor panel having the construction illustrated in the Swensen, copending U.S. patent application Ser. No. 264,932, filed May 18, 1981 (assigned to the assignee of the present invention). Such application is incorporated herein by reference in its entirety to illustrate the full structure of one particular floor panel to which the present invention is applicable.

Such floor panel includes an upper plate 16 and a lower frame or support member 17 which is welded to the lower surface of the upper plate 16 and is shaped to provide a beam system extending across the panel to provide a relatively rigid, lightweight panel structure. As best illustrated in such copending application, the frame member 17 provides patterns of legs 18 which extend laterally between the upper and lower surface of the panel and are welded to the upper surface.

As illustrated in FIG. 3, a tubular metal socket 15 provides a flange 19 and a tubular portion 20. The flange 19 is welded to the upper plate in one of the zones defined by associated legs 18. The upper plate 16 is formed with an opening 21, aligned with the socket 15, having a diameter substantially equal to the internal diameter of the tubular portion 20 of the socket 15.

In the embodiment of FIG. 3, the stud 14 is threaded and provides a diameter sized to closely fit the socket 15. In this embodiment, adjustment is provided so that the height of the screen above the floor surface 12 can be adjusted. The stud is threaded, at least at its lower end, to receive a first nut 22 which is threaded along the stud 14 and engages the floor surface 12 to adjustably determine the vertical position of the stud with respect to the floor. A second nut 23 is threaded onto the lower end of the stud 14 and engages the lower end of the socket to clamp the stud in its position to prevent it from rattling and also to prevent it from moving in an upward direction with respect to the floor panel. Access to the second nut 23 can be obtained by removing an adjacent panel during the installation of the stud.

The upper end of the stud is provided with a rectangular flange 24 which is proportioned to fit within a track 26 secured to the lower edge of the landscape screen 13. The flange 24 may be secured to the stud in any suitable manner, such as by welds 27. The track 26 is preferably formed of sheet metal providing a central portion 28 which fits against the lower edge of the landscape screen. Opposite edges of the track are formed with reverse bends at 29 and 31, which cooperate to provide opposed grooves proportioned to embrace opposite edges of the flange 24 and to provide an interfitting structure which connects the stud and track while allowing longitudinal movement of the stud along the track.

In the embodiment of FIG. 3, the landscape screen is provided with a wood core 32 sandwiched between side panels 33 formed of any suitable material, such as sheet metal, paneling, or other decorative surface material. In such instance, the track may be mounted on the landscape screen by relatively long wood screws 34 which are threaded into the track and up into the wood core 32. As discussed in detail below, other means for mounting the tracks may be provided, depending upon the landscape screen structure. In any event, the strength of the connection between the track 26 and the screen 13 must be sufficiently great to prevent the track from being pulled loose in the event the screen is bumped or otherwise subjected to lateral forces.

It is also preferable to provide means to lock the position of the stud along the track. FIG. 4 illustrates one form of lock. Such locking structure is provided by a setscrew 36 which is threaded into the flange 24 so that when it is tightened, it presses up against the center portion 28 of the track and frictionally locks the flange in its adjusted position along the track.

Referring to FIG. 2, the panels are preferably provided with sockets 15 which are eccentrically located with respect to the center of the panels 10. In the embodiment illustrated in FIG. 2, the sockets 15 are located near one panel corner. For example, in panels which are about two feet square, the studs may be located about four inches in from the two intersecting side edges of the panel so that they are located substantially adjacent to one corner of the panel but spaced a distance therefrom.

When the sockets are located eccentrically of the panel, a given single socket in a given panel can be positioned in any one of four positions within the floor structure by merely turning the panel to a selected one of the four positions in which it can be inserted within the floor system.

As illustrated in FIG. 2, a landscape screen **13*a* can be positioned at one diagonal with respect to the panels, a screen 13*b* can be positioned to extend at an angle of about 45 degrees with respect to the two panels, or a curved landscape panel 13*c* can be provided. The tracks for curved panels are curved to match the curve of the panels. It should be noted that landscape screens of substantially different lengths can also be mounted on the floor structure. The landscape screens would normally not be mounted in the relative positions of FIG. 2. FIG. 2, however, illustrates some of the various mounting positions provided by this invention and demonstrates that the present invention allows for the mounting of panels in a large variety of positions, even when a given floor panel is only provided with one socket 15**. Further, it is not necessary to locate the studs at the ends of the screen, and the studs can be positioned at an appropriate position along the length of the screen to properly position the screen in the desired position on the floor system. Still further, the screens may, if desired, be positioned to abut along an edge or edges to form corners. Also, the screens can be positioned to abut existing walls. When screens abut, it is desirable to interconnect the screens for greater strength.

In practice, it is preferable to provide sockets in only a portion of the floor panels 10 so that the floor panels on which screens are not mounted do not have any openings therein. When it is desired to position a screen in a particular location, a floor panel having a socket therein is positioned at the appropriate location within the floor system and is oriented within the floor system to position the socket at the desired location within the floor system. By providing the sockets in an eccentric location from the center of the floor panel, a given panel can be inserted with the socket in any one of four positions when the panels are square. If, on the other hand, the panels are rectangular, a given socket, even though eccentrically located, could only be positioned in one of two positions within the floor system. Although floor panels with a single socket are illustrated, it is within the broader aspects of this invention to provide floor panels with two or more sockets. When multiple sockets are provided, they are preferably nonsymmetrical so as to provide further optional positioning of the sockets within a floor.

Referring to FIG. 5, a mounting system is illustrated for securing the track 26 on the lower edge of a screen 13 formed, for example, of a foam core. In order to provide good anchoring of the track on such a panel, the track is provided with relatively long rods 41 which extend a substantial distance up along the screen and provide good anchoring of the track on the screen for greater strength. Here again, studs 14 are mounted in the track 26 and extend into sockets 15 (not illustrated in FIG. 5) in the floor panels 10.

Figure 6:
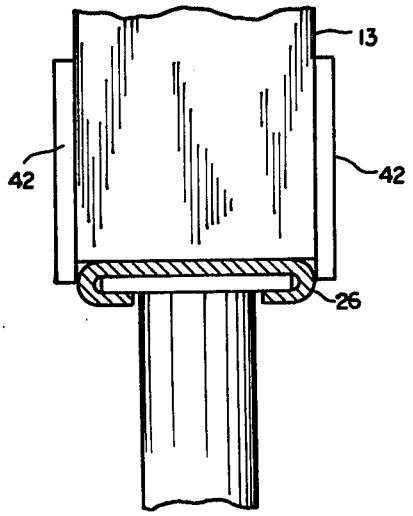
FIG. 6 is a fragmentary section of another track anchoring system.

FIG. 6 illustrates another embodiment for mounting the track 26 on a screen 13. In such embodiment, side plates 42, welded at their lower edge to opposite sides of the track 26, extend up along the surface of the screen a sufficient distance to properly support the screen on the track. The side plates of such embodiment are spaced apart a distance proportioned to closely fit the sides of the screen and may be secured to the screen by adhesive or screws (not illustrated). This embodiment is normally used with screens which do not provide a sufficiently strong core to support the screen with a core connection.

Figure 7:
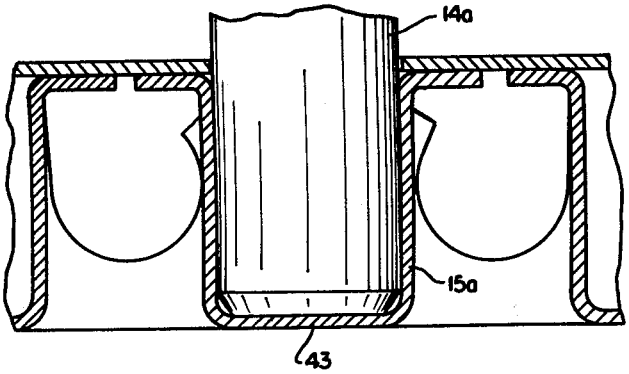
FIG. 7 is a fragmentary view similar to FIG. 3 but illustrating another embodiment of socket and stud structure in which there is no vertical adjustment provided.

FIG. 7 illustrates another embodiment in which no height adjustment is provided for the stud. In this embodiment, a stud 14*a* is not provided with threads, and merely extends down into a socket 15*a* providing a closed lower end 43. In such embodiment, the stud 14*a* is preferably formed to fit into the socket 15*a* with a close fit so that the stud does not have to be clamped in the socket by opposed nuts, as illustrated in FIG. 3. The embodiment of FIG. 7 has the advantage of not requiring threads on the stud and also permitting easier insertion and removal of the studs, since they are not clamped on the underside of the panel and no access is therefore required beneath the panel for the screen mounting.

Figure 8:
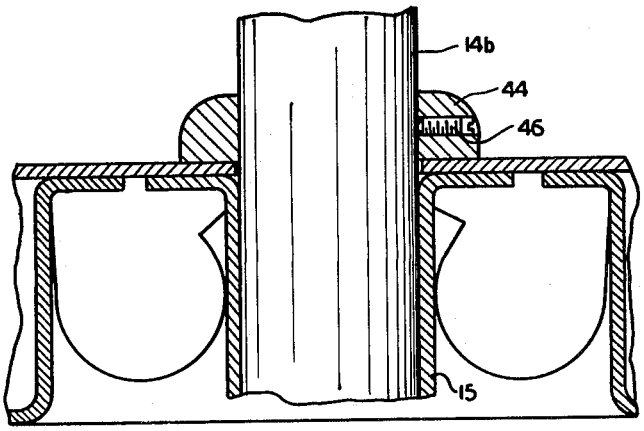
FIG. 8 is a fragmentary view similar to FIGS. 3 and 7 but illustrating still another embodiment of stud and socket anchoring structure.

FIG. 8 illustrates still another embodiment in which height adjustment is again provided but which does not require threads on the stud. In this embodiment, the stud 14*b* is provided with a collar 44 which is locked at any desired position along the stud by a setscrew 46 to adjustably determine the height of the screen above the floor. In this embodiment, the stud 14*b* is again sized to closely fit the socket 15 so that the screen is properly positioned and does not rattle.

In all of the embodiments, the elements of the structure are sized so that sufficient strength is provided to support the screen against any lateral loading which is normally encountered. In units in which heavy lateral loading may be encountered, the sockets may be secured to the floor panel at both the upper and lower ends thereof to provide additional strength. Further, the size or diameter of the studs is appropriately selected to provide sufficient strength, and the gauge of the material forming the track is selected to provide sufficient strength to properly support the screen. In the embodiments in which vertical adjustment is provided, of course, the screens can be adjusted vertically. In the embodiment of FIG. 7, however, the height of the screen above the floor is determined solely by the length of the stud which is used to support the screen.

Although the preferred embodiments of this invention have been shown and described, it should be understood that various modifications and rearrangements of the parts may be resorted to without departing from the scope of the invention as disclosed and claimed herein.

What is claimed is:

1. A floor-mounted landscape screen system comprising a plurality of floor panels each providing a floor surface and which cooperate when said panels are assembled to provide a floor structure, at least some of said panels providing sockets open through said floor surface thereof, studs structured to mount in one of said sockets, a mounting bracket adapted to be mounted on the lower edge of a landscape screen, said bracket and stud providing an interfitting connection permitting adjustment of said stud to a plurality of positions along the length of said screen and securely locking said stud and bracket in each of said positions, said bracket and stud permitting at least two spaced studs to be secured to a screen and to be adjusted to spaced positions corresponding to the spacing between at least two associated sockets and positioned therein, said studs, sockets, and brackets providing sufficient strength to support said screens against normal forces to be encountered and being separable to permit repositioning of an associated screen.

2. A floor system as set forth in claim 1, wherein said stud projects above said floor surface when positioned within an associated socket.

3. A floor system as set forth in claim 2, wherein adjustment means are provided to adjust the position of said bracket with respect to said floor surface when said system is assembled.

4. A floor system as set forth in claim 3, wherein said adjustment means includes adjustment members adjustable axially along said studs at locations spaced from the ends thereof and engageable with said floor surface to determine the axial position to said stud with respect to said floor surface while said studs extend beyond said adjustment member into said sockets.

5. A floor system as set forth in claim 4, wherein said adjustment members are threaded on said stud.

6. A floor system as set forth in claim 5, wherein a lock member is adapted to be threaded on said stud below said floor surface to cooperate with said adjustment member and lock said stud against axial movement relative to said floor surface.

7. A floor system as set forth in claim 4, wherein a lock member is adapted to be mounted on said stud below said floor surface to cooperate with said adjustment member to lock said studs against axial movement relative to said floor surface.

8. A floor system as set forth in claim 4, wherein said adjustment member is a collar positioned around said stud providing lock means to lock said collar with respect to said stud.

9. A floor system as set forth in claim 2, wherein a collar is provided to engage said floor surface and determine the axial position of said stud with respect thereto.

10. A floor system as set forth in claim 2, wherein said sockets include a tubular portion and a radial surface spaced back from said floor surface engageable with a radial surface on said stud to limit movement of said stud into an associated socket.

11. A floor system as set forth in claim 1, wherein said bracket is a track including anchor means extendable vertically along said screen to anchor said track on an associated screen.

12. A floor system as set forth in claim 1, wherein said anchor means includes an elongated member which is adapted to extend up along the interior of an associated screen.

13. A floor system as set forth in claim 11, wherein said anchor means includes opposite members secured to said track adapted to engage opposite sides of an associated screen.

14. A floor system as set forth in claim 1, wherein said sockets are eccentrically located in said some of said panels, and said panels are installable in a plurality of positions to selectively locate said sockets in a plurality of locations.

15. A floor system as set forth in claim 14, wherein said panels are square and are installable in four different positions.

16. A floor system as set forth in claim 1, wherein said bracket is a track, said interfitting means includes opposed grooves on said track and opposed projections on said stud which extend into associated grooves and limit relative movement between said track and studs except lengthwise of said track.

17. A floor system as set forth in claim 1, wherein said panels are supported on pedestals, and said panels are individually removable and replaceable.

18. A floor-mounted furniture member comprising in combination a plurality of floor panels, each providing a floor surface and which cooperate to provide a floor surface, said panels being individually removable and installable, at least some of said panels providing sockets open through said floor surface thereof, a mounting bracket secured to said furniture member, a plurality of studs adjustably connected to said mounting bracket providing an interfitting connection permitting adjustment of said studs to a plurality of positions with respect to said bracket and for locking said studs in such positions, said studs being adjustable with respect to said bracket so that at least two spacd studs are adjusted to spaced positions corresponding to the spacing between at least two associated sockets and are positioned in said two associated sockets, said studs, sockets and brackets providing sufficient strength to support said furniture member against normal forces encountered and being separable to permit repositioning of said furniture item with respect to said floor panels.

19. A floor-mounted system as set forth in claim 18 wherein said furniture item is a landscape screen and said studs are adjustable along the length of said screen.

* * * * *